United States Patent [19]

McCormick et al.

[11] 4,111,475

[45] Sep. 5, 1978

[54] SELF-LATCHING YOKE GATE LATCH

[76] Inventors: Donald Hugh McCormick, 1408 Pioneer Way; William Weldon Perkins, 12044 Royal Rd., #20, both of El Cajon, Calif. 92020

[21] Appl. No.: 798,340

[22] Filed: May 19, 1977

[51] Int. Cl.[2] ..... E05C 3/24

[52] U.S. Cl. ..... 292/216; 292/DIG. 38; 292/207

[58] Field of Search ..... 292/216, DIG. 38, 114, 292/109, 177-182, 207

[56] References Cited

U.S. PATENT DOCUMENTS

| | | | |
|---|---|---|---|
| 2,246,344 | 6/1941 | Calderwood | 292/207 X |
| 3,918,753 | 11/1975 | McCormack et al. | 292/216 |

FOREIGN PATENT DOCUMENTS

| | | | |
|---|---|---|---|
| 2,409,733 | 4/1975 | Fed. Rep. of Germany | 292/DIG. 38 |

*Primary Examiner*—Richard E. Moore
*Attorney, Agent, or Firm*—Brown & Martin

[57] ABSTRACT

A gate latch of the type incorporating a pivotally mounted yoke in a latch body and a remote latch actuator handle is provided with an actuator pin and latch body relationship that further restricts the operation of the latch to operation by depressing the actuator handle. A recess in the latch body receives a horizontal segment of the latch pin in the latched position. Repeatable actuation of the latch and proper relatching on closure of the gate is assured by frictional relationship between the terminus of the latch pin and the underside of the latch yoke. The latch pin has a relatively large area in contact with the yoke during operation so that lower hardness materials may be employed. A hardened tapered bushing in the yoke is utilized to insure, capture and entry of the latch pin into the latch bore. The latch operator includes an integral stop to limit the travel of the latch pin so that relatching is assured.

6 Claims, 5 Drawing Figures

SELF-LATCHING YOKE GATE LATCH

BACKGROUND OF THE INVENTION

As set forth more fully in applicant's-assignor's U.S. Pat. No. 3,918,753 issued Nov. 11, 1975 for "Automatic Gate Latch", there is a need for latches utilized on gates and chain length fences. Such latches should be easily operated by an adult but in installations such as where the chain link fence surrounds a hazard to small children (swimming pools and the like), it is desirable to have a latch which limits operation by small children.

The latch disclosed in the reference patent solves many of the deficiencies in prior art devices. However, features of the self-latching gate latch described in the patent limits its practical application. In particular, the use of an independent bracket as a stop member requires careful attention to installation detail to obtain proper operation of the latch. If the bracket is mispositioned, then it may be possible for users to completely withdraw the latch pin from the latch body thereby defeating the operation of the latch. In addition, it is possible, through the use of pry tools such as a screwdriver, for even a small child to withdraw the latch pin from the latch yoke without reaching the operator's handle. In the patented device, metal or other material of similar hardness must be employed for the latch body because proper latching operation is dependent on the correct frictional relationship between the latch actuator tube and the upper surface of the latch body. In addition, a relatively pointed latch pin must be utilized so that upon gate closure the pin will engage the latch bore in the yoke and stop the movement of the latch so that the latch pin may fully enter the latch bore. Such an arrangement produces a restricting compromise between the "sharpness" of the latch pin and the wear relationship of the sharpened latch pin and the underside of the latch yoke. If a latch pin is sufficiently sharp to assure regular actuation, then it tends to wear a groove even in the yoke materials, thereby producing a limited latch lifetime.

It is therefore desirable to provide a self-latching yoke gate latch with improved simplicity of installation, reduced wear, cost and improved reliability of operation.

SUMMARY OF THE INVENTION

In an exemplary embodiment of the invention, the deficiencies of prior art latching yoke gate latches are corrected. The requirement for hardenable materials is eliminated so that high impact plastic materials may be employed for the major components of the device. The employment of plastic reduces material costs and manufacturing costs. The relatively low hardness of such materials is accommodated by utilizing a blunt ended latch pin. The latch pin has a relatively large area of contact with the under-surface of the yoke. Accordingly, wear is spread over a much larger area.

A tapered and hardened bushing is received in the latch bore with the widest opening facing downwardly. The narrowest portion of the bushing corresponds generally to the diameter of the latch pin. Therefore, during closing of the gate as the latch pin moves across the surface of the latch yoke, it is guided into the latch bore by the wide opening of the tapered bushing and upon being fully inserted into the bushing, is tightly engaged by the narrow portion of the bushing. Thus, the use of the tapered bushing not only eliminates the need for a sharpened latch pin, but also accommodates full engagement of the latch pin within the confines of the latch yoke itself and thereby eliminates the need for a bore that penetrates through the upper portion of the yoke. The design now makes it impossible, utilizing simple prying tools, to operate the latch at the latch body.

The spring bias for the latch pin is provided by a spring operating between the latch operator handle and the latch actuator tube. The maximum travel of the latch operator handle is determined by the difference between the extended length of the spring and the fully compressed length of the spring when the several coils of the spring are in contact. This distance is preselected to be less than the distance necessary to withdraw the latch pin from the latch body. Thus, an internal stop is provided which prevents defeating the operating of the latch by fully withdrawing the latch pin manually.

It is therefore an object of the invention to provide an improved self-latching yoke gate latch with improved resistance to tampering, reduced material and manufacturing costs, and increased durability.

Other objects and many attendant advantages of the invention will become more apparent upon a reading of the following detailed description together with the drawings in which like reference numerals refer to like parts throughout and in which:

DETAILED DESCRIPTION OF THE DRAWINGS

Figure 1:
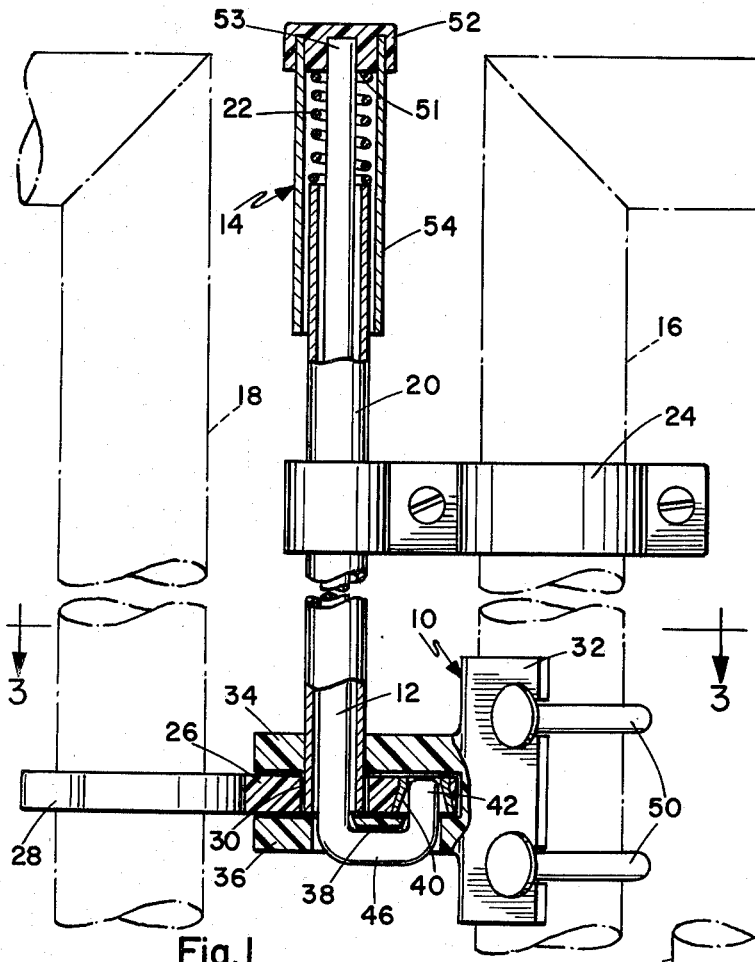
FIG. 1 is a side elevation view, with portions cut away, of the gate latch structure in closed position.

Referring now to the drawings, there is illustrated a latch body 10 pivotally mounting a latch yoke 26. The latch body also receives a latch actuator tube 20 that houses the latch pin 12. The latch body 10 incorporates the mounting portion 32 which is received on a vertical fence support 16 and to retained on the fence support by two U-bolt and nut combinations 50. A bracket 24 secures the upper portion of tube 20 to fence support 16.

Figure 2:
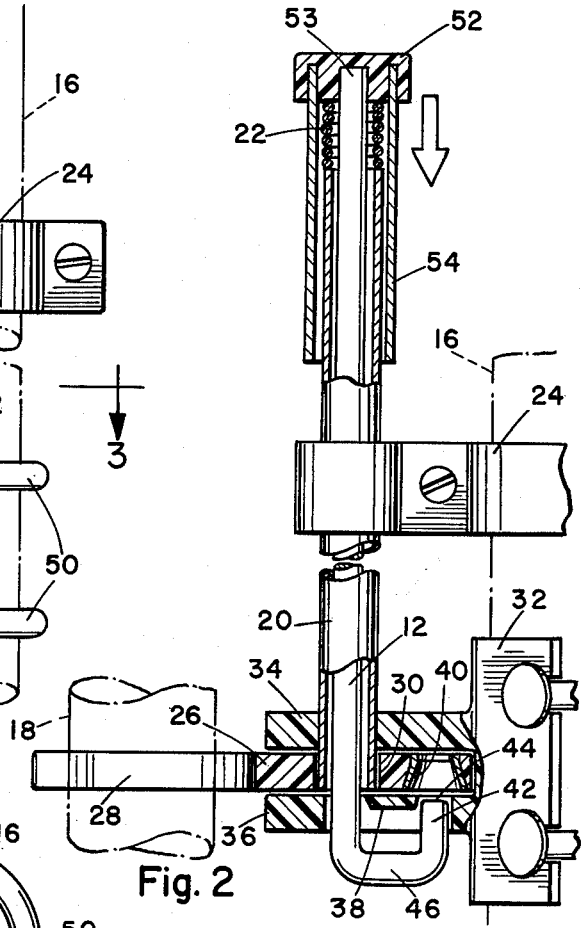
FIG. 2 is a view similar to portions of FIG. 1, showing the gate in an unlatched position.

The latch body incorporates upper and lower extensions 34 and 36 which are spaced for reception of the latch yoke 26. The upper body portion 34 has a bore which receives the latch actuator tube 20 and latch pin 12, whereas the lower body portion 36 has a bore sized to receive only the latch pin 12. The lower body portion 36 also has a recess 38 for the horizontal segment 46 on the latch pin 12. The recess 38 is sized to accommodate the horizontal segment 46 with relatively little clearance on the sides and ends. Therefore, it is not possible to insert a pry tool and obtain a purchase on the upper surface of the horizontal segment 46. A sufficient portion of the horizontal segment 46 is protected by the walls of the recess so that it is also not possible to grasp the segment 46 with pliers or similar tools. The vertical latching segment 42 of the latch pin 12 reciprocates in a second bore through the lower body portion 36 between the latch open position illustrated in FIG. 2 and the latch closed position illustrated in FIG. 1.

Figure 3:
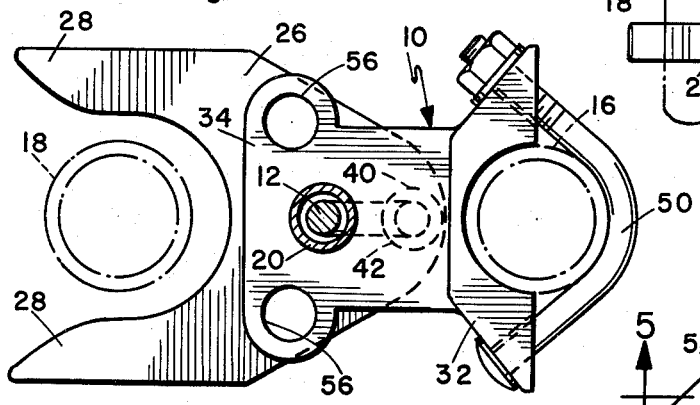
FIG. 3 is a sectional view taken on line 3—3 of FIG. 1.
Figure 4:
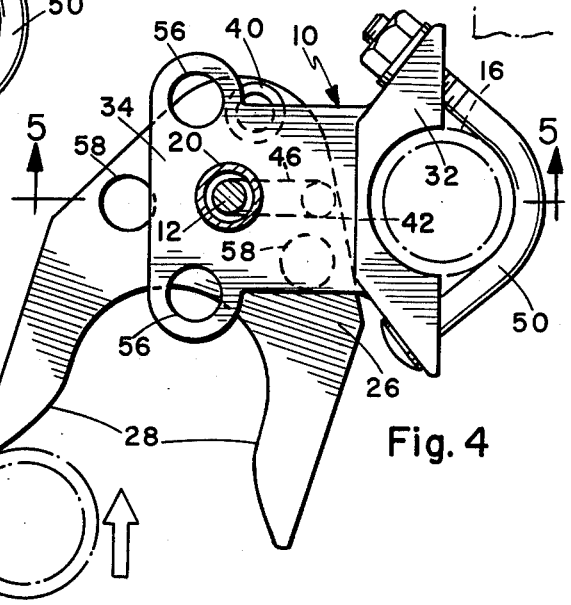
FIG. 4 is a similar sectional view, but with the latch open.
Figure 5:
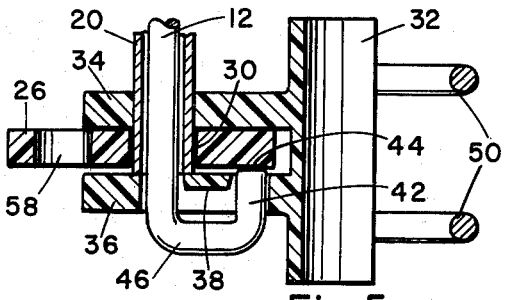
FIG. 5 is a sectional view similar to portions of FIG. 2, but showing the latch pin in contact with the under-surface of the yoke.

The yoke 26 has a central bore 30 which forms a pivot bearing around the latch actuator tube 20 for pivoting of the yoke between a gate unlatched position illustrated in FIG. 4, and the gate latched position illustrated in FIG. 3. The vertical post of the gate 18 is engaged by the arms 28 to prevent the gate from moving when the latch is in the latched position and to engage the gate as it closes to relatch the latch, such as illustrated in FIG. 4. The maximum movement of the yoke is limited so that the yoke cannot be foreceably moved beyond a position where it will engage the post 18. At the opposite end of the yoke, a bore is provided for cooperation with the latch pin 12. A tapered hardened bushing 40 is received in the bore with the widest opening facing toward the vertical latching segment 42. The wide opening of the bushing 40 insures that the latch pin will be captured as the latch rotates from the gate unlatched to the gate latched positions by insuring that there will be sufficient time for the segment 42 to be drawn into the bushing by spring bias, to engage the bushing 40, and to be guided by the tapering wall into the narrow end of the bushing. The narrow end of the bushing 40 is substantially the same diameter as the outer diameter of the latch pin 42. This relationship eliminates play and unwanted movement of the yoke in the latch position. The relatively large entry opening of the bushing makes it possible to have a substantially flattened terminal portion 44 on the latch pin 42, so that gouging and other wear of the yoke is minimized. The relationship of the surface 44 to the yoke is illustrated in FIG. 5. The end 44 has a relatively large area of surface contact with the yoke 26 so that a relatively soft material, such as high impact plastic, can be utilized to reduce material and production costs without comprising the durability of the assembly. The friction between the surface 44 and the yoke holds the yoke in the open position (FIG. 4) until it is reengaged by vertical support 18. FIG. 4 illustrates the padlock bores 56 on the latch body and bores 58 on the yoke which permit padlock locking of the yoke in the latched position.

The latch operator 14 incorporates a operator handle with a depending skirt 54 and cap 52. A spring 22 is positioned between a spring abutment surface 51 on the cap 52 and the upper end of the actuator tube 20. The cap 52 is secured to the upper end 53 of the latch pin. If unrestricted vertical travel of the latch pin were permitted, then it would be possible to completely withdraw the latch pin from the yoke, rotate and release it, so that it becomes non-functional. Therefore, the relationship between the operator cap 52 and the upper surface of the actuator tubr 20 is selected to cause the spring 22 to act as a limit stop when fully compressed (illustrated in FIG. 2). At the full extent of permitted travel, the latch pin 42 is still within the latch body and therefore cannot be rotated out of engagement.

Having described our invention, we now claim:

1. An improved self-latching yoke gate latch including a latch body mounted on a first vertical support, a latch yoke pivotally supported on a bearing axis in said latch body for pivotal movement between gate open and gate latched positions, a latch pin receivable in a latch bore in said latch yoke spaced from said bearing axis, said latch pin having a vertical latching segment, and a vertical operator segment, and a latch operator connected to said vertical operator segment for selectively withdrawing said latch pin from said latch bore, the invention comprising:

a latch pin recess in said latch body for accommodating a horizontal segment of said latch pin, said recess generally conforming to the length and width of said horizontal segment to limit entry of pry tools into said recess, said latch pin vertical latching segment terminating in a blunt end having a substantial area of contact with the undersurface of said latch yoke, a tapered bushing received in said latch bore, said tapered bushing being comprised of a material having a greater hardness than the hardness of said latch yoke, said bushing having an opening that tapers from a diameter substantially greater than said latch pin to a diameter substantially equal to that of said latch pin.

2. The improved self-latching yoke gate latch according to claim 1, wherein:

said latch operator segment of said latch pin is enclosed by a latch actuator tube, and said latch actuator tube is received in a bore through the upper part of said latch body and in a bore through said latch yoke.

3. The improved self-latching yoke gate latch according to claim 2, wherein:

said latch body and said latch yoke are comprised of plastic material.

4. The improved self-latching yoke gate latch according to claim 3, wherein:

said bushing is comprised of a material having a hardness greater than the hardness of said latch yoke and said latch body.

5. The improved self-latching yoke gate latch according to claim 4, wherein:

said bushing is comprised of metal.

6. The improved self-latching yoke gate latch according to claim 1, wherein:

said latch operator incorporates an operator handle having a cap with a spring abutment surface, a latch actuator tube surrounding said latch actuator pin between said body and said latch operator handle.

a spring compressed between said spring abutment surface and the upper portion of said latch actuator tube, the maximum extension of said spring being limited by contact between the horizontal segment of said latch pin and said latch recess, and the maximum compression of said spring being limited by contact between the several coils of the spring compressed between said spring abutment surface and said actuator tube, the total distance between maximum extension and maximum compression being less than the distance necessary to withdraw said blunt end of said latch pin clear of said latch body.

* * * * *